United States Patent [19]

Rosenwinkel et al.

[11] Patent Number: 4,569,527

[45] Date of Patent: Feb. 11, 1986

[54] TREASURE GAME WITH SEPARABLE, CHANGEABLE SURFACES

[75] Inventors: Donald A. Rosenwinkel, Oak Park; Jeffrey D. Breslow, Highland Park; John V. Zaruba, Chicago, all of Ill.

[73] Assignee: Marvin Glass & Associates, Chicago, Ill.

[21] Appl. No.: 550,966

[22] Filed: Nov. 14, 1983

[51] Int. Cl.[4] ..... A63F 3/00

[52] U.S. Cl. ..... 273/251; 273/283; 273/284

[58] Field of Search ..... 273/254, 284, 283, 243, 273/248, 242, 249, 251, 252

[56] References Cited

U.S. PATENT DOCUMENTS

| | | | |
|---|---|---|---|
| 1,656,943 | 1/1928 | Firestone | 273/254 |
| 2,635,881 | 4/1953 | Cooney | 273/254 X |
| 3,556,528 | 1/1971 | Spiring | 273/254 |
| 3,871,657 | 3/1975 | Lorenz et al. | 273/241 X |
| 3,874,671 | 4/1975 | Smith | 273/254 |
| 3,942,800 | 3/1976 | Holbrook | 273/254 X |
| 3,951,411 | 4/1976 | Hill et al. | 273/243 |
| 4,093,236 | 6/1978 | Hoffa | 273/255 |
| 4,341,386 | 7/1982 | Kleva | 273/239 |
| 4,477,080 | 10/1984 | Baker | 273/241 |

FOREIGN PATENT DOCUMENTS

| | | | |
|---|---|---|---|
| 3003314 | 8/1981 | Fed. Rep. of Germany | 273/283 |
| 694880 | 7/1953 | United Kingdom | 273/284 |
| 2049442 | 12/1980 | United Kingdom | 273/243 |

*Primary Examiner*—Richard C. Pinkham
*Assistant Examiner*—Scott Brown
*Attorney, Agent, or Firm*—John S. Pacocha

[57] ABSTRACT

A game in which the players construct a mansion during the course of play using a series of separate pieces representing rooms on different levels of the mansion. Each piece has a number of doorway connections one of which must be aligned with a doorway connection of another piece to interface the pieces. In addition, each piece contains a number of locations which the player must investigate to acquire assistance in obtaining the objective of the game which is to locate a treasure and escape from the mansion with the treasure. Frames of different height are provided to support the room pieces at different levels and step pieces are also provided to innerconnect rooms at different levels. Secret passages are provided to move from one room to another without having to move through the connecting doorways.

20 Claims, 11 Drawing Figures

BEDROOM
DEN
CONSERVATORY
LIBRARY
HALLWAY
ENTRANCE
OPEN
CLOSED

TREASURE GAME WITH SEPARABLE, CHANGEABLE SURFACES

BACKGROUND OF THE INVENTION

1. Field of the Invention

This invention relates generally to board type games and more particularly to a game in which the players construct the playing field as part of the play of the game.

2. Background Art

Board games in which two or more players move from area to area in pursuit of an objective have long been popular. In such prior art board games the players move along a peripheral or circuitous path defined on the board encountering various aids and obstacles to the pursuit of the game objective. Examples of such prior art include the games disclosed in U.S. Pat. Nos. 2,165,891; 3,169,768; 3,861,686; 3,865,379; 3,885,792; 3,989,251; 3,994,499; 4,128,246; and 4,341,385. One disadvantage of such prior art board games is that the available path remains the same from one game to another. In addition, since it is generally desirable that such games be readily storable and portable, the board limits the size and shape of the playing field and restricts it to two dimensions.

SUMMARY OF THE INVENTION

The present invention is concerned with providing a game for two or more players in which the players themselves construct the playing field during play of the game. This and other objects and advantages of the invention are achieved by a game including a plurality of separate playing pieces each supportable upon a surface and each defining a surface area on which game markers move. Each of the playing pieces has a number of player selectable connections for directly interfacing the piece with other pieces to create a path for the movement of the markers in pursuing the game objective. Conveniently, the pieces depict a room with various doorways for connecting one room to the other and also include rooms of different regions or floors. Support frames may be used to provide a different height for each of the floors. The transition between different floors is made through a piece depicting a room having a doorway leading to a stairway. Players move from room to room determining by the roll of a die whether the player may exit a room through a selected door. Should the player exit a room through a door not already connected to another room, the player has the opportunity to pick another room and align a doorway of the new room to make it part of the playing field. In each room there is at least one hiding place that the player may investigate while in the room. Some hiding places are more difficult to investigate than others. The player must first check the easier hiding places to try and obtain help for investigation of the more difficult hiding places where treasure chests, keys to the treasure, secret passages and other important assistance may be found.

BRIEF DESCRIPTION OF THE DRAWING

For a better understanding of the present invention, reference may be had to the accompanying drawings in which.

DETAILED DESCRIPTION OF THE PREFERRED EMBODIMENT

Figures 1, 2, 3:
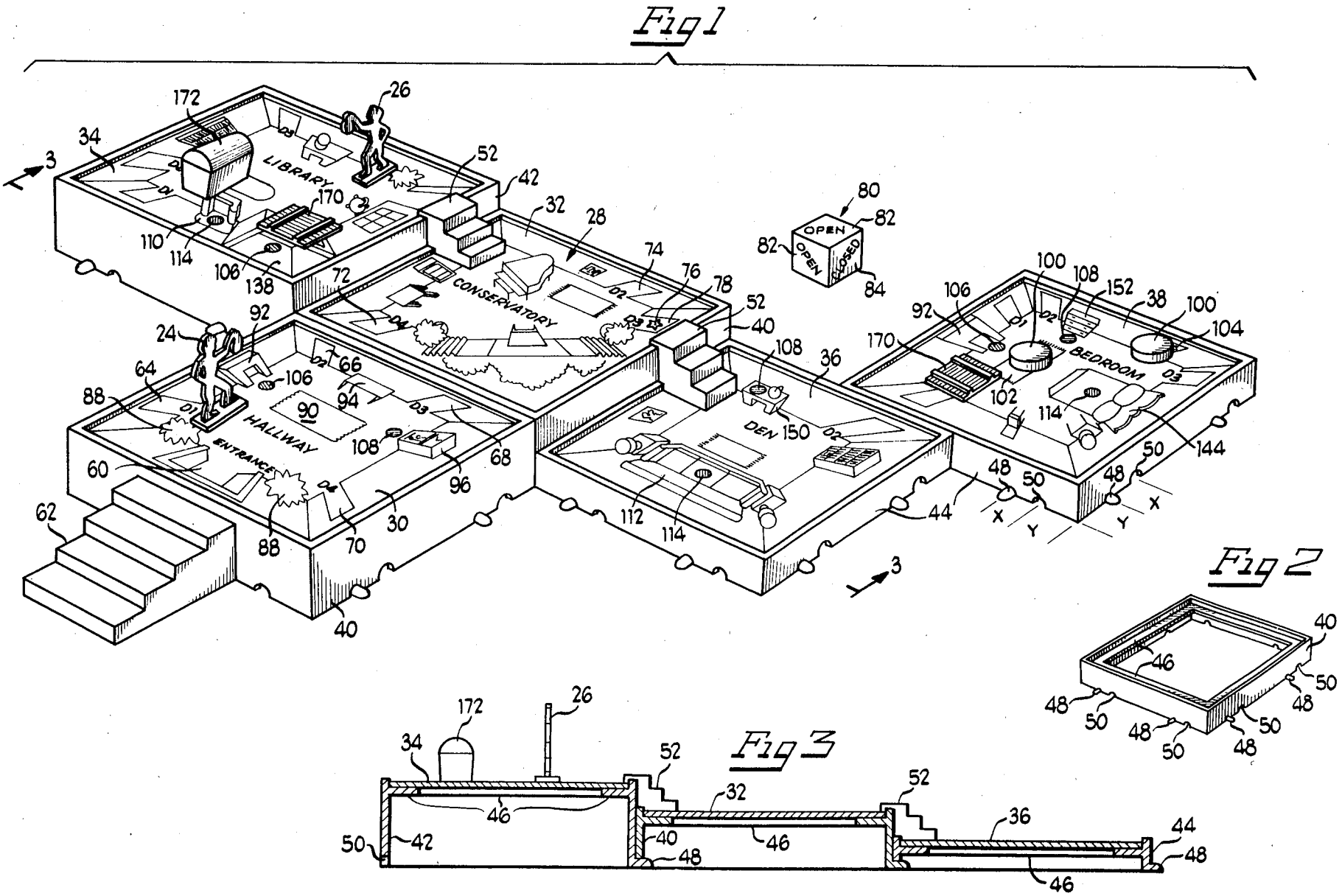
FIG. 1 is a perspective view of an embodiment of the present invention showing a game in play.
FIG. 2 is a reduced scale, perspective view of one of the frames shown in FIG. 1 with the room piece removed.
FIG. 3 is a reduced scale, sectional view taken generally along the line 3—3 of FIG. 1.
Figure 4:
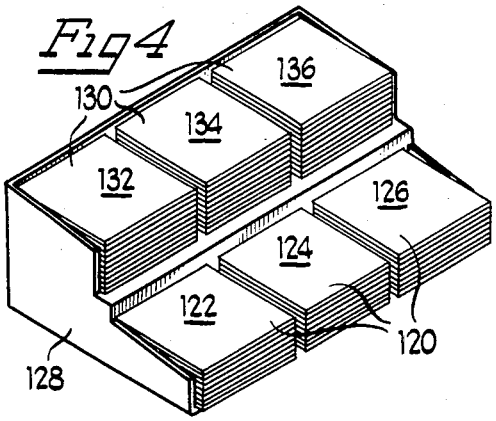
FIG. 4 is a perspective view of a card stack holder used in the invention.
Figure 5:
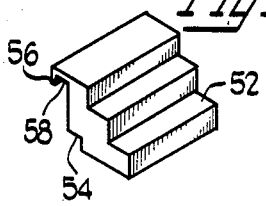
FIG. 5 is a perspective view of a stairway piece.
Figure 6:
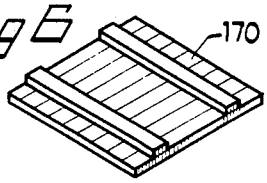
FIG. 6 is an enlarged scale, perspective view of a secret passage token.

Referring now to the drawings in which like parts are designated by like reference numerals throughout the several views, a game 20 embodying the present invention is shown in FIG. 1 in the course of play on any generally planar surface such as a table or floor. In this embodiment two or more players are to enter a mysterious mansion in pursuit of treasure, constructing the mansion as they move through it, and then escape with the treasure. As shown, each of two players is assigned a marker 24 or 26 that is movable about the mansion or playing field 28. Separate area pieces 30, 32, 34, 36 and 38 depict rooms in one point perspective interface with at least one of the other room pieces to construct the mansion. Of course, the rooms can be depicted in more usual two dimension graphics. Among the pieces 30–38 are room areas of different regions or levels of the mansion playing field. In alternative embodiments, the pieces could show areas of related regions such as subways, streets and elevated trains, or swamps, forests and mountains.

Each of the pieces 30–38 may be made of about one-sixteenth inch thick card stock cut into approximately four inch squares. Although the pieces do not have to be of any particular size or shape, the four inch squares have been found to be sufficiently large to accommodate a number of markers such as 24 and 26 of a conveniently manipulable size as well as other game tokens while permitting the construction of a variety of mansion floor plans on a conventional card table. Similarly, while the pieces could be made of a hexagonal, octagonal or even circular shape, the squares are relatively easy to manufacture and provide enough variations of interfacing configuration for entertaining play.

Since the areas depicted in this embodiment are rooms of a mansion, it is convenient to divide the regions into different levels or floors, thus the pieces 30 and 32 designated as the HALLWAY and the CONSERVATORY, respectively, are identified as main floor rooms. Piece 34 shows the LIBRARY which is an upper level room, and pieces 36 and 38, respectively, depict a DEN and BEDROOM in the lower level. While the various regions or levels may be distinguished by means of room names or other alphanumeric indicia, color coding has been found convenient particularly since another feature of this invention only requires differentiation among the various levels on the backs (not shown in the drawing) of the pieces. Although each of the pieces 30–38 may be placed directly upon a planar supporting surface, such as a table, it is preferred to support each of those pieces on a frame at a height relative to the room level. Thus, pieces 30 and 32 are each respectively supported upon mid-height frames 40 while piece 34 is supported on a taller or higher frame 42 and the lower level floor pieces 36 and 38 are supported on the shortest frames 44. The difference in height from a main level frame 40 and an upper level 42 is the same as the difference in height between a main level frame 40 and a lower level frame 44.

In FIG. 2 one of the frames 40 is shown without the room piece. The details described with respect to frame 40 also apply to frames 42 and 44 which differ only in overall height. Each frame has a shelf 46 along the entire inner periphery spaced a distance down from the top of the frame greater than, about one and one-half times, the thickness of the room pieces. Shelf 46 extends inwardly a sufficient distance to adequately support a room piece bearing a number of tokens used in the play of the game.

Along the lower edge of each side of the frame 40 there are spaced pairs of a pin 48 and a hole 50. The distance "X" between each pin 48 and the nearest adjacent hole 50 is the same on each side of each frame. In addition, the distance "Y" from each corner to the nearest pin 48 or hole 50 is equal. For example, with a four inch side square frame the first pin 48 looking from left to right along either of the outer sides shown in FIG. 2 could be located approximately three-quarters of an inch from the corner with the nearest hole 50 being one-half inch from that pin. The second pin 48 on the same side would then be two and three-quarter inches from the left hand corner with its adjacent hole 50 being three and one-quarter inches from the left hand corner or three-quarters of an inch from the right hand corner. Thus, as is illustrated in FIGS. 1 and 3, the frames 40, 42 and 44, regardless of their height, may be fitted together in either one of two relationships. Frames 30 and 32, 32 and 34, plus 32 and 36 are fully aligned or abutting, while frames 36 and 38 are partially offset.

In order to provide a transition between the different frame levels, step pieces 52 are provided. Each step piece 52 is formed with a lower notch 54 to accommodate the projection of the upper edge of the side of the lower frame such as frame 44 above the top surface of a room piece such as 36 as is shown in FIGS. 1 and 3. For similar purposes, step piece 52 is provided with an upper inverted "L" shaped latch hook 56 which forms a notch 58 that fits over the upper projecting edge of the adjacent higher frame that extends above the room piece.

Play of the game is started by placement of an initial room piece such as the HALLWAY piece 30 which has an ENTRANCE 60 designated for entry into and exit from the mansion playing field. To help identify ENTRANCE 60 another step piece 62 is provided that may be attached to a frame 40 by means of a mating pin and hole (not shown) that will engage an inner hole 50 and pin 48 on one side of the frame. Again taking as an example a four inch side frame, a step piece 62 could be made approximately two inches in length with a pin spaced one-quarter of an inch from one edge and a hole spaced one-quarter of an inch from the other edge along the face of the step piece that will abut the frame member 40. Alternatively, a dedicated HALLWAY frame (not shown) could be provided with the front steps permanently secured to the frame or with an integrally formed frame and steps.

The area or room defined by each piece 30–38 has at least two connections or doorways. Thus, HALLWAY 30 has, in addition to the dedicated front entry/exit 60, four doors 64, 66, 68 and 70. As will be appreciated from the showing in FIG. 1, each doorway is spaced from a corner of the piece a distance such that the doorway is substantially in between a pin 48 and hole 50 pair on the frame. While each room piece may be provided with as many as eight doors, it is preferable for enhancing entertaining and challenging play to provide the room pieces, other than HALLWAY 30, with from two to four doorways. Additional room pieces are interfaced with the HALLWAY piece 30, or any other piece that has already been placed in play, by interfacing the connections or doorways of the rooms.

Although not absolutely necessary, alphanumeric designations of the various doorway connections on a particular room card piece facilitate player identification of a particular doorway for announcement of the player's intentions during the course of play. Thus, as shown in FIG. 1, the four doorways 64, 66, 68 and 70 are identified by the designations D1, D2, D3 and D4, respectively. It will be appreciated that other identification means such as color coding, names or graphic symbols could be employed to distinguish the various doorways within a room.

While doorway 72 of the CONSERVATORY piece 32 is aligned with doorway 66 of piece 30, doorway 72 could have been aligned with any one of the other doorway connections 64, 68 or 70. Likewise, doorway 74 of piece 32 could have been aligned with any one of the doorways 64–70. As play progresses, the choice of which doorway of a piece may be interfaced with an already placed piece is sometimes limited by prior placed pieces. Another interfacing limitation results from the fact that some of the main level pieces are also designated as transition pieces between the other levels. A transition piece, such as piece 32, is identified by having one or more doorway connections with a star 76 indicating that the door leads to a stairway. The CONSERVATORY 32 has a star 76 at doorway 78 leading to the lower level DEN 36 and another door "D1" with a star that is covered by the step piece 52 connecting the upper level LIBRARY 34. When a player is interfacing a transition piece such as 32 with an already placed piece of the main level, the doorways with stars should not be aligned with another main level piece. All of the transition pieces are main level pieces.

In order to move from one area or room to another the player must move through connected doorways. A chance device in the form of a six sided cubic die 80 is provided for determining whether a player selected doorway is open or closed in order to determine whether the player may proceed from one area to another. The die 80 has five "OPEN" sides 82 and one "CLOSED" side 84. If the player selects a doorway such as 74 that is not yet connected to another area and, upon rolling the die 80, finds the doorway is open, the player is then free to select and interface another room card piece. Unless the player is leaving a room through a transition doorway with a star leading to a stairway, the player selects another room card piece with the same color back as the color level of the room being exited. However, if the player is leaving through a transition connection as indicated by a doorway with a star, the player has the choice of selecting a higher or lower level room. As was previously mentioned, the various levels or floors are color coded on back of the room pieces so the player may pick the proper level from a face-down pile of room pieces. After the player selects and interfaces any doorway connection of room piece of another level, a step piece 52 is then put into place covering the aligned doorway of the lower piece.

Within the room area defined by each of the pieces 30–38 there are a number of locations at which the player may seek assistance in pursuit of the game's treasure objective. Such locations are graphically indicated by a representation of a piece of furniture, an item covering the floor or wall, a plant, or some part of the room such as a fireplace or closet. Hence, in the HALLWAY 30 there are plants 88, rug 90, fireplace 92, table 94 and grandfather clock 96. Similar hiding places or locations are depicted on each of the other room pieces. The player in the area defined on a particular piece is entitled to investigate locations on that piece which have not already been investigated. Once an investigation is made, the player covers the hiding place with a token 100. As illustrated, a player has already looked under the rug 102 and behind the picture 104 in the BEDROOM 38.

The locations within each room are divided into first and second order sites since some of the hiding places are more difficult to investigate than others. Generally, each room area is provided with from six to seven locations with about half being the first order sites that are less difficult to investigate. For example, in HALLWAY 30 it is relatively easy to investigate the plants 88, the rug 90 and table 94 without assistance. However, in order for the player to look into the dark depths of the fireplace chimney 92 some additional light is required. Accordingly, the difficulty of investigating the fireplace 92 is designated by a green coded dot 106 which also indicates that some visual assistance is required. Grandfather clock 96 is locked and accordingly cannot be looked into without the assistance of some tool to help open it. The difficulty and the required assistance are indicated by means of a blue colored dot 108. Yet other items such as the sofa 112 in the DEN 36 are too heavy to move without assistance which is indicated by means of a red colored dot 114. The generally equal division of the locations into first and second order sites has not been maintained in the other pieces shown in FIG. 1 for convenience of illustration.

First order sites, those not designated by a colored dot 106, 108 or 114, may be investigated without any assistance and lead to the acquisition of assistance in the form of first order initial assistance cards 120. The cards are conveniently divided into three different stacks 122, 124 and 126 with each stack being designated for a particular level or floor of the mansion. To facilitate such arrangement of the cards a tray 128 is provided which houses not only the first or lower order cards in three different stacks but similarly provides for a higher order set of further assistance cards 130 divided into three different stacks 132, 134 and 136. Dividing the first set of initial assistance cards 120 and the second set of further assistance cards 130 into separate stacks for each floor has been found to enhance the play of the game, particularly since there will be times when all of the cards of one set may be depleted on a particular floor. Card sets 120 and 130 are differentiated from each other by different colored backs or some other distinguishing indicia. In addition, the further assistance cards 130 bear indicia on the backs of the cards correlating the cards to a particular level or floor. For example, all of the cards 132 may have the same color coding on the back as is used to color code the lower level floor cards such as 36 and 38. The purpose for so dividing the further assistance cards is to avoid all of a particular type of assistance card being on the same level by chance. Although there are different types of initial assistance cards, because of their nature and the fact that there are only three different types it is not as critical to avoid chance separation as with the cards 130.

Among the initial assistance cards affecting the progress of the player in obtaining the game objective are cards that provide the visual assistance required to look into areas such as the fireplace chimney 92 in rooms 30 and 38 as well as the closet 138 depicted on the LIBRARY piece 34. The visual assistance cards may bear representations of items such as matches as on card 140, a magnifying glass as on card 142, a lantern (not shown) or a candle (not shown). In order to move the stuffed chair 110, sofa 112, bed 144 and other heavy objects identified with a red dot 114, assistance is provided by a crowbar card 146, a servant card 148, a rope card (not shown) or a dolly card (not shown). Items designated by a blue dot 108, such as the desk 150 in the DEN 36 or the locked chest of drawers 152 in the BEDROOM 38, require the assistance of a key card 154 or a knife card 156 to pry open the locked drawer or else a hammer card (not shown) or a screwdriver card (not shown). Each of the three types of initial assistance card faces have a colored dot correlating the type of assistance provided with the different difficulties presented by the second order sites.

Figure 11:
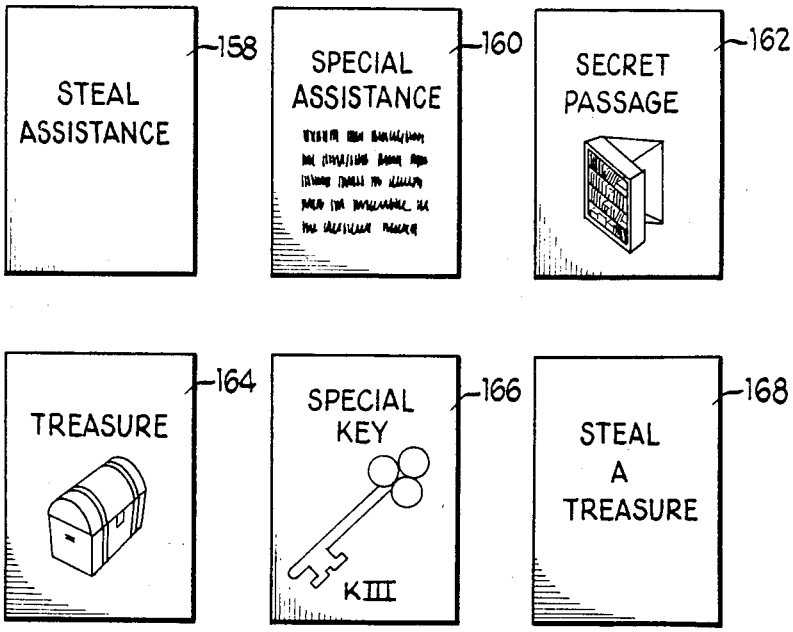
FIG. 11 is a top plan view of the further assistance cards.

As a player proceeds through the mansion investigating the various locations, a collection of initial assistance cards 120 are acquired. Eventually, the initial assistance cards will be used in trying to acquire the further assistance provided by cards 130. Faces of the cards 130 are shown in FIG. 11 and include "STEAL ASSISTANCE" cards 158, "SPECIAL ASSISTANCE" cards 160, "SECRET PASSAGE" cards 162, "TREASURE" cards 164, "SPECIAL KEY" cards 166, and "STEAL A TREASURE" cards 168.

"STEAL ASSISTANCE" cards 158 permit a player to select an initial assistance card 120 or a further assistance card 130 from every other player. Some "SPECIAL ASSISTANCE" cards 168 permit a player to immediately trade the card for two initial assistance cards 120, while others allow a player to look at any two second order sites, either during the same or in different turns.

"SECRET PASSAGE" cards 162 enable a player to discover a secret passage and move from any one room of the mansion to any other room, other than HALLWAY 30, without having to pass through the interface connections or doorways. When a player uses a "SECRET PASSAGE" card 162, a secret passage token 170 is required in each of the rooms being exited and entered by means of the secret passage. In using the "SECRET PASSAGE" card 162, the player may either place secret passage entry/exit tokens 170 or take advantage of an already placed secret passage token 170. Thus, as shown in FIG. 1, a player has constructed a passage between the BEDROOM 38 in the lower level and LIBRARY 34 in the upper level. Any player having a "SECRET PASSAGE" card may now move between the LIBRARY and the BEDROOM without having to pass through the intermediate DEN 36 and CONSERVATORY 32. The game is conveniently provided with six secret passage tokens 170. After all six tokens 170 have been placed, no new secret passages may be constructed.

Figure 7:
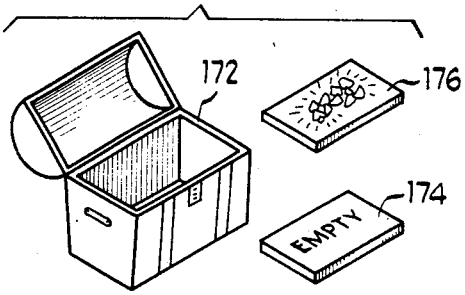
FIG. 7 is an enlarged scale, perspective view of an open treasure chest and the tokens that fit inside.
Figure 8:
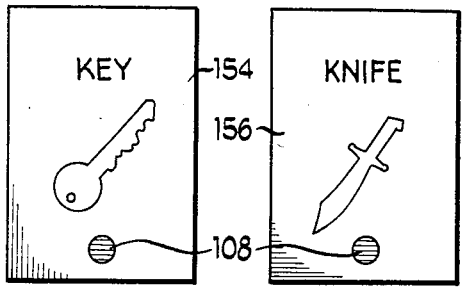
FIG. 8 is a top plan view of the face of two of the first type of initial assistance cards.
Figure 9:
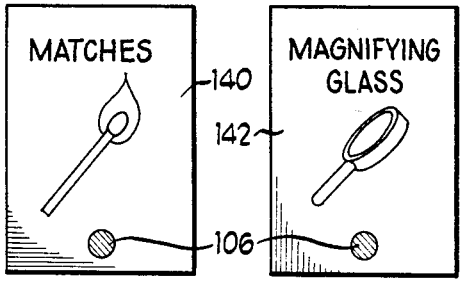
FIG. 9 is a top plan view of the face of two of the second type of initial assistance cards.
Figure 10:
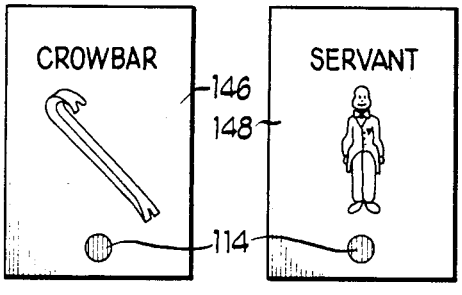
FIG. 10 is a top plan view of the face of two of the third type of initial assistance cards.

When a player acquires a "TREASURE" card 164, the player selects a treasure chest token 172. Conveniently, seven of such treasure chests are provided. As is best shown in FIG. 7, the treasure chest token 172 is an openable container which may house either an "EMPTY" token 174 or a treasure token 176. Five of the chests 172 contain an "EMPTY" token 174 while only two actually contain treasure 176. On the bottom of each chest 172 there is an identifying indicia (not shown) such as a number from "I" to "VII". In order to take possession of the treasure chest the player must have the correct "SPECIAL KEY" card with the same identifying indicia as the treasure chest. As shown in FIG. 11, "SPECIAL KEY" card 166 bears a designation "K III" which will unlock a similarly identified treasure chest. If the player does not have the necessary "SPECIAL KEY", then the chest token is left on the site that the player investigated to obtain the "TREASURE" card 164 as illustrated in FIG. 1 where a treasure chest 172 has been left in the LIBRARY 34. The identifying indicia on the bottom of the treasure chest is not disclosed. If the player finding the chest does not have the key card necessary to open it, the chest remains in the room where it was discovered. Another player having a "SPECIAL KEY" card and wishing to try to open the chest must go into the room containing the chest 172 in order to try and open it.

Having possession of a treasure chest 172, the player may elect to escape from the mansion either through the connecting doors of room pieces already in place or by constructing an additional portion of the mansion to get back to the HALLWAY 30 and escape out of the ENTRANCE 60. Only when the player is outside of the mansion is the player allowed to open the treasure chest and find out whether the player has escaped with a treasure 174 to win the game. Rather than immediately attempting to escape the mansion upon acquiring possession of a chest 172, the player may try to obtain additional chests to increase the chances of having an actual treasure. While there is no limit to the number of treasure chests 172 a player may carry, possession of one or more of the chests 172 does encumber a player to the extent that a player is no longer able to fit through a secret passage. If, upon escaping the mansion with a treasure chest 172, the player finds that the chest is empty, the player must go back into the mansion to again try to obtain an actual treasure. However, every turn that a player remains in the mansion after obtaining a chest 172 exposes the player to the danger of theft. "STEAL A TREASURE" cards 168 permit a player to steal a treasure from any other player having possession of a treasure as long as the players are in the same room at the time the "STEAL A TREASURE" card is played.

Each player has a turn consisting of three moves which the player may allocate among the options of: investigating a location within the room occupied by the player; attempting to move through a door connection; taking a secret passage; or stealing a treasure. The player may combine the moves in any order during a turn. Although playing a "STEAL ASSISTANCE" card 158 does not count as a move within a turn, only one such card may be played during a turn.

While a particular embodiment of the invention has been shown and described with some alternatives, it will be apparent to those skilled in the art that further changes and modifications may be made without departing from the invention. It is intended in the appended claims to cover all such changes and modifications as fall within the true spirit and scope of the invention.

What is claimed as new and desired to be secured by Letters Patent is:

1. A game played by two or more players moving from area to area in pursuit of an objective comprising:
   an object to be obtained to win the game;
   a marker for each player;
   a plurality of separate multisided playing pieces each supportable upon a surface and each defining a surface area on which the markers move;
   each side of each piece being of the same length;
   each piece having at least two connections for directly interfacing the piece with other adjacent pieces to create at least one pathway for the movement of the markers from one adjacent area to another adjacent area;
   each connection being at a predetermined distance from the nearest end of the side containing the connection;
   at least some of the pieces having less than two connections on each side;
   means to assist the players in obtaining the object;
   each piece having at least one location within the area for acquiring the assistance means;
   the pieces including first region pieces and second region pieces;
   transition pieces to be used between different region pieces;
   the regions being distinguished by height; and
   the transition pieces including step pieces.

2. The game of claim 1 in which the pieces are square and thin relative to the length of each side of the square.

3. The game of claim 1 including third region pieces.

4. The game of claim 1 in which first frame means are provided for supporting one of the first region pieces at a first height and second frame means are provided for supporting one of the second region pieces at a second height.

5. The game of claim 4 in which the frame means include interlocking means for interfacing the frame means in accordance with the interfaced pieces supported on the frame means.

6. The game of claim 1 including player positionable passage means for defining an additional pathway for the movement of the markers from one area containing a player positioned passage means to another area containing a player positioned passage means.

7. The game of claim 1 in which the assistance means includes first order assistance means and second order assistance means.

8. The game of claim 7 in which:
   the first order assistance means comprises a first set of cards;
   the second order assistance means comprises a second set of cards; and
   the backs of said first and second set of cards are distinguishable.

9. The game of claim 1 in which:
   there are a plurality of locations on each piece;
   the locations include first order sites and second order sites;

the assistance means include first order assistance means and second order assistance means; and a first order assistance means acquired from the first order site is necessary to acquire a second order assistance means from the second order sites.

10. The game of claim 9 in which:

the first order assistance means include assistance means of more than one type;

the second order sites include sites of more than one type; and each type of first order assistance means correlates with a type of second order site.

11. The game of claim 1 including chance means for determining whether a player's marker may be moved out of an area through a player selected connection.

12. The game of claim 1 including an initial starting piece having a defined entrance and exit.

13. The game of claim 1 including a number of articles and the object needed to win the game is contained in at least one of the articles.

14. A game played by two or more players moving from area to area in pursuit of an objective comprising:

an object to be obtained to win the game;

a marker for each player;

a plurality of separate multisided playing pieces each supportable upon a surface and each defining a surface area on which the markers move;

each piece having a plurality of player selectable connections for directly interfacing a connection of one piece with a connection of another adjacent piece to create at least one pathway for the movement of the markers from one adjacent area to another adjacent area;

means to assist the players in obtaining the object;

each piece having at least one location within the area for acquiring the assistance means;

the pieces including first, second, and third region pieces with the regions distinguished by height;

transition step pieces between different region pieces; and first, second and third support means for respectively supporting the first, second, and third region pieces at their respective heights.

15. The game of claim 14 in which indicia distinguish each of the first, second, and third support means from each other.

16. The game of claim 14 in which the player selectable connections permit interfacing the piece with other adjacent pieces in a partially offset arrangement.

17. The game of claim 14 in which frame means are provided for supporting pieces of at least two of the regions at their respective heights.

18. A game played by two or more players moving from area to area in pursuit of an objective comprising:

an object to be obtained to win a game;

a marker for each player;

a plurality of separate multiside playing pieces, each supportable on a surface and each defining a surface area on which the markers move;

means to assist the players in obtaining the objective;

each piece having at least one location within the area for acquiring the assistance means;

each piece having a plurality of player selectable connections for directly interfacing a connection of one piece with a connection of another adjacent piece to create at least one pathway for the movement of the markers having one adjacent area to another adjacent area;

each of the pieces being of one of three different heights and the connections permitting interfacing the sides of adjacent playing pieces either fully aligned or partially offset; and player positionable passage means for defining an additional pathway for the movement of the markers from one area containing a player positioned passage means to another area containing a player positioned passage means.

19. The game of claim 10 in which frame means are provided for supporting of at least two of the three different heights.

20. The game of claim 18 including transition pieces to be used between adjacent playing pieces of different heights.

* * * * *